United States Patent [19]

Kato et al.

[11] Patent Number: 5,035,971

[45] Date of Patent: Jul. 30, 1991

[54] ELECTROSTATIC PHOTOGRAPHIC LIQUID DEVELOPER

[75] Inventors: Eiichi Kato; Kazuo Ishii, both of Shizuoka, Japan

[73] Assignee: Fuji Photo Film Co., Ltd., Kanagawa, Japan

[21] Appl. No.: 427,386

[22] Filed: Oct. 27, 1989

[30] Foreign Application Priority Data

Oct. 27, 1988 [JP] Japan ..... 63-269468

[51] Int. Cl.[5] ..... G03G 9/12

[52] U.S. Cl. ..... 430/114; 430/119

[58] Field of Search ..... 430/114, 119, 137

[56] References Cited

U.S. PATENT DOCUMENTS

| | | | |
|---|---|---|---|
| 4,579,803 | 4/1986 | Kato et al. | 430/114 |
| 4,665,002 | 5/1987 | Dan et al. | 430/114 |
| 4,837,102 | 6/1989 | Dan et al. | 430/137 |
| 4,842,975 | 1/1989 | Kato et al. | 430/137 |

FOREIGN PATENT DOCUMENTS 0155788 9/1985 European Pat. Off. .

OTHER PUBLICATIONS

Patent Abstracts of Japan, vol. 10, No. 38.

*Primary Examiner*—John Goodrow

*Attorney, Agent, or Firm*—Sughrue, Mion, Zinn Macpeak & Seas

[57] ABSTRACT

An electrostatic photographic liquid developer comprising a nonaqueous solvent with an electric resistance of $10^9$ Ωcm or more and a dielectric constant of 3.5 or less, having a resin dispersed therein, wherein dispersion resin particles are copolymer resin particles obtained by the copolymerization reaction of solutions containing at least one monofunctional monomer (A) which is soluble in the nonaqueous solvent but which is rendered insoluble by polymerization, and monomer (B) which is represented by the general formula (II) below

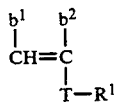

(II)

wherein $R^1$ represents an aliphatic group with 8 or more carbon atoms;

T represents —COO—, —CONH—,

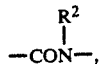

where $R^2$ represents an aliphatic group, —OCO—, —$CH_2$COO— or —O—; and $b^1$ and $b^2$, which may be the same or different, each represents a hydrogen atom, an alkyl group, a —$COOR^3$ group or a —$CH_2$—$COOR^3$ group, where $R^3$ represents an aliphatic group, which contains an aliphatic group with 8 or more carbon atoms and which produces a copolymer by polymerization with monomer (A); in the presence of a dispersion stabilization resin which is soluble in the nonaqueous solvent, which comprises an acidic group selected from the group consisting of a —$PO_3H_2$ group, an —$SO_3H$ group, a —COOH group, an —OH group, an —SH group, or a

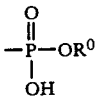

group, where $R^0$ denotes a hydrocarbon bonded only to one terminal of at least one main polymer chain and which is a polymer containing the repeating unit represented by the following general formula (I)

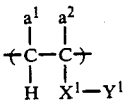

(I)

wherein $X^1$ represents —COO—, —OCO—, —$CH_2$OCO—, —$CH_2$COO—, —O— or —$SO_2$—;

$Y^1$ represents an aliphatic group with 6 to 32 carbon atoms; and $a^1$ and $a^2$, which may be the same or different, each represents a hydrogen atom, a halogen atom, a cyano group, a hydrocarbon group with 1 to 8 carbon atoms, a—COO—$Z^1$ group, or a —COO—$Z^1$ group linked via a hydrocarbon group with 1 to 8 carbon atoms, where $Z^1$ represents a hydrocarbon group with 1 to 22 carbon atoms; and wherein a portion of said polymer is crosslinked.

7 Claims, No Drawings

ELECTROSTATIC PHOTOGRAPHIC LIQUID DEVELOPER

FIELD OF THE INVENTION

This invention relates to an electrostatic photographic liquid developer comprising a dispersion of at least a resin in a carrier solution with an electric resistance of $10^9$ Ωcm or more and a dielectric constant of 3.5 or less, and, in particular, it relates to a liquid developer with outstanding redispersibility, storage properties, stability, image reproduction properties and fixing properties.

BACKGROUND OF THE INVENTION

In general, with electrophotographic liquid developers, carbon black, Nigrosine, phthalocyanine blue and other organic and inorganic pigments and dyes and alkyd resins, acrylic resins, rosin, synthetic rubbers and other natural or synthetic resins are dispersed in a high resistance/low dielectric constant liquid such as a petroleum-based aliphatic hydrocarbon, and a polarity controlling agent such as a polymer containing a metal soap, lecithin, linseed oil, higher fatty acid or vinylpyrrolidone is added.

The resin was dispersed in such developers as insoluble latex particles in a particle form with a diameter of a few nanometers to a few hundred nanometers. However, with conventional liquid developers, a soluble resin for dispersion stabilization and the polarity controlling agent assume a form in which they were readily diffusible in solution since there was insufficient bonding between the soluble resin for dispersion stabilization and the polarity controlling agent and insoluble latex particles. For this reason, there are the disadvantages that long term storage and repeated use cause the soluble resin for dispersion stabilization to separate from the insoluble latex particles, the particles sediment, agglutinate and accumulate and the polarity becomes indistinct. Further, because the particles which have agglutinated and accumulated are difficult to redisperse, the particles remain adhering to the developing apparatus and stain the image portion and a breakdown of the developing apparatus, for example, by blocking the liquid feed pump occurs.

In order to remedy this disadvantage, there has been a proposal whereby the soluble resin for dispersion stabilization and the insoluble latex particles are chemically bonded is disclosed in, for example, U.S. Pat. No. 3,990,980. However, although these liquid developers have to some extent improved dispersion stability of the particles with respect to natural sedimentation, they are not yet satisfactory. Moreover, when used in actual developing devices, they have the disadvantages that they are unsatisfactory in terms of practical redispersion stability in that the toner adhering to various parts of the device hardens into a coated film and redispersion is difficult. In addition, they also become a cause of breakdown in the device, reprographic image staining and the like. Further, in the production of the resin particles described above, there are notable restrictions on the combination of the dispersion stabilizer and insolubilizing monomer which are used to produce monodisperse particles with a narrow particle size distribution. As a general rule, particles with a broad particle size distribution containing large amounts of coarse particles, or polydisperse particles in which 2 or more average particle sizes are present result. Further, it is difficult to obtain the desired average particle size with monodisperse particles with a narrow particle size distribution and large particles of 1 μm or more or extremely fine particles of 0.1 μm or less are formed. In addition, there are additional problems, for example, the dispersion stabilizer used must be produced by a production process which is complicated and requires a long time.

Further, in order to eliminate the abovementioned disadvantages, methods for improving the degree of dispersion, the redispersibility and the storage stability of the particles by using insoluble dispersion resin particles which are copolymers of an insolubilizing monomer and a monomer containing a long chain alkyl moiety or a monomer containing 2 or more types of polar components are disclosed in JP-A No. 60-179751 and JP-A No. 62-151868 (the term "JP-A" as used herein refers to a "published unexamined Japanese patent application"). Further, methods for improving the degree of dispersion, redispersibility and storage stability of the particles by using insoluble dispersion resin particles of copolymers of insolubilizing monomers and monomers containing long chain alkyl moieties in the presence of polymers which make use of bifunctional monomers or monomers which make use of macromolecular reactions are disclosed in JP-A No. 60-185963 and JP-A No. 61-63855.

Recently, investigations have been made into methods for printing large numbers of copies, at least 5,000 copies or more, employing an offset printing masterplate using an electrophotographic system, and improvements in masterplates have been made, in particular. As a result, it has become possible to print 10,000 copies or more with a large plate size. In addition, the shortening in the operation time for electrophotographic plate making system has also advanced and improvements in the rapidity of the developing/fixing stages are being made.

Dispersion resin particles produced in accordance with the procedures disclosed in the above-mentioned JP-A No. 60-179751, JP-A No. 62-151868, JP-A No. 60-185963 and JP-A No. 61-63855 have not necessarily resulted in a satisfactory performance in the dispersibility or redispersibility of the particles when the developing speed has been increased, nor in the printing resistance when the fixing time has been shortened or in cases involving large sized masterplates (for example, size A3 or larger).

This invention is to resolve the problems of conventional liquid developers as outlined above.

SUMMARY OF THE INVENTION

An object of this invention is to provide a liquid developer with outstanding dispersion stability, redispersibility and fixing properties even in electrophotographic printing systems using large size masterplates and in which the development/fixing stages have been speeded up.

Another object of this invention is to provide a liquid developer which allows offset printing baseplates having outstanding printing ink receptivity and durability in printing to be produced by an electrophotographic method A further object of this invention is to provide a liquid developer which is suitable for various electrostatic photographic uses and various transfer uses in addition to the applications mentioned above.

Yet another object of this invention is to provide a liquid developer which can be used in a variety of systems in which it is possible to use liquid developers such as ink jet recording, cathode ray tube recording and recording relying on processes such as pressure changes or static electrical changes.

The objects of this invention are achieved by an electrostatic photographic liquid developer comprising a nonaqueous solvent with an electric resistance of $10^9$ cm or more and a dielectric constant of 3.5 or less, having a resin dispersed therein, where the dispersed resin particles are copolymer resin particles obtained by the copolymerization of solutions containing at least one monofunctional monomer (A) which is soluble in the nonaqueous solvent but which is rendered insoluble by polymerization, and at least one monomer (B) represented by the following general formula (II)

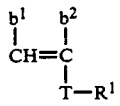

(II)

wherein $R^1$ represents an aliphatic group with 8 or more carbon atoms;

T represents —COO—, —CONH—,

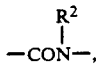

where $R^2$ represents an aliphatic group, —OCO—, —$CH_2$COO— or —O—; and $b^1$ and $b^2$, which may be the same or different, each represents a hydrogen atom, an alkyl group, —$COOR^3$ or —$CH_2$—$COOR^3$ where $R^3$ represents an aliphatic group, which contains an aliphatic group with 8 or more carbon atoms and which is copolymerizable with monomer (A); in the presence of a dispersion stabilization resin which is soluble in the nonaqueous solvent, which is produced by bonding an acidic group selected from the group consisting of a —$PO_3H_2$ group, an —$SO_3H$ group, a —COOH group, an —OH group, an —SH group, or a

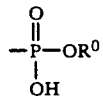

group, where $R^0$ denotes a hydrocarbon, onto only one terminal of at least one main polymer chain and which is a polymer containing the repeating unit represented by the following general formula (I)

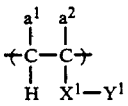

(I)

wherein $X^1$ represents —COO—, —OCO—, —$CH_2$OCO—, —$CH_2$COO—, —O— or —$SO_2$—;

$Y^1$ represents an aliphatic group with 6 to 32 carbon atoms; and $a^1$ and $a^2$, which may be the same or different, each represents a hydrogen atom, a halogen atom, a cyano group, a hydrocarbon group with 1 to 8 carbon atoms, —COO—$Z^1$ or —COO—$Z^1$ linked via a hydrocarbon group with 1 to 8 carbon atoms, where $Z^1$ represents a hydrocarbon group with 1 to 22 carbon atoms; and wherein a portion of said polymer is crosslinked.

DETAILED DESCRIPTION OF THE INVENTION

The liquid developer of this invention is explained in detail below.

The carrier liquid with an electric resistance of $10^9$ Ωcm or more and a dielectric constant of 3.5 or less which is used in this invention can be preferably straight chain or branched aliphatic hydrocarbons, alicyclic hydrocarbons, aromatic hydrocarbons and halogen-substituted derivatives thereof. For example, octane, isooctane, decane, isodecane, decalin, nonane, dodecane, isododecane, cyclohexane, cyclooctane, cyclodecane, benzene, toluene, xylene, mesitylene, Isopar E, Isopar G, Isopar H and Isopar L (Isopar is a trade name of the Exxon Company), Shellsol 70, Shellsol 71 (Shellsol is a trade name of the Shell Oil Company), Amsco OMS Amsco 460 solvents (Amsco is a trade name of the Spirits Company), and the like can be used either alone or in mixtures.

The nonaqueous dispersion resin particles which are a very important structural component in this invention (and which will also be referred to as "latex particles" hereinbelow) are produced as polymer particles by the copolymerization of monofunctional monomer (A) and monomer (B) which has an aliphatic group with 8 or more carbon atoms in the nonaqueous solvent, in the presence of a dispersion stabilization resin which is produced by bonding an acidic group selected from the group consisting of a —$PO_3H_2$ group, and —$SO_3H$ group, a —COOH group, an —OH group, an —SH group, or a

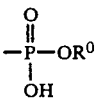

group, where $R^0$ denotes a hydrocarbon group, onto only one terminal of at least one main polymer chain and which is a polymer containing a repeating unit represented by the above-mentioned general formula (I) and a portion of the polymer chains of which are crosslinked.

It is basically possible to use any nonaqueous solvent provided it is miscible in the above-mentioned carrier solution for the electrostatic photographic liquid developer.

Thus, substances which are miscible with the above-mentioned carrier solution are suitable as solvents which are used when producing the dispersion resin particles. For example, straight chain or branched aliphatic hydrocarbons, alicyclic hydrocarbons, aromatic hydrocarbons and halogen-substituted derivatives thereof are preferred. Specific examples include hexanone, octane, isooctane, decane, isodecane, decalin, nonane, dodecane, isododecane, Isopar E, Isopar G, Isopar H, Isopar L, Shellsol 70, Shellsol71, Amsco OMS and Amsco 460 and other such solvents are used either alone or as mixtures.

In addition to these organic solvents, solvents which can be used in admixture therewith include, for example, alcohols (for example, methyl alcohol, ethyl alcohol, propyl alcohol, butyl alcohol and fluorinated alcohol), ketones (for example, acetone, methyl ethyl ketone, cyclohexanone), carboxylic acid esters (for example, methyl acetate, ethyl acetate, propyl acetate, butyl acetate, methyl propionate, ethyl propionate), ethers (for example, diethyl ether, dipropyl ether, tetrahydrofuran, dioxane), and halogenated hydrocarbons (for example, methylene dichloride, chloroform, carbon tetrachloride, dichloroethane, methylchloroform).

The nonaqueous solvents which are used in admixture are preferably distilled off by heating or under reduced pressure after polymeric particle production, but even if they are carried over into the liquid developer as latex particle dispersions, there will be no problems if the electric resistance of the developing solution is such that it is $10^9$ Ωcm or greater.

Normally, it is preferred to use a solvent which is the same as the carrier liquid in the resin dispersion production stage, and, as mentioned previously, it is possible to mention straight chain or branched aliphatic hydrocarbons, alicyclic hydrocarbons, aromatic hydrocarbons and halogen-substituted hydrocarbons.

The dispersion stabilization resin of this invention which is used in a nonaqueous solvent to form a stable resin dispersion of the copolymer which is insoluble in the solvent and is produced by copolymerization of monofunctional monomer (A) and monomer (B) which has an aliphatic group with 8 or more carbon atoms, is a polymer containing repeating units represented by the general formula (I), a portion of the polymer chains of which are crosslinked, and is a polymer which is soluble in the nonaqueous solvent, produced by bonding an acidic group selected from the group consisting of a $-PO_3H_2$ group, an $-SO_3H$ group, a $-COOH$ group, an $-OH$ group, an $-SH$ group or a

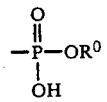

group, where $R^0$ denotes a hydrocarbon group, onto only one terminal of at least one main polymer chain.

The repeating unit represented by general formula (I) is explained in further detail below.

Aliphatic groups and hydrocarbon groups in the repeating unit represented by general formula (I) may be substituted.

In general formula (I), $X^1$ preferably represents $-COO-$, $-OCO-$, $-CH_2OCO-$, $-CH_2COO-$ or $-O-$, and more preferably represents $-COO-$, $-CH_2COO-$ or $-O-$.

$Y^1$ preferably represents an alkyl group, an alkenyl group or an aralkyl group with 8 to 22 carbon atoms, which may be substituted. Examples of substituent groups include substituent groups such as halogen atoms (for example, fluorine, chlorine, bromine), $-O-Z^2$, $-COO-Z^2$ and $-OCO-Z^2$ (where $Z^2$ represents an alkyl group with 6 to 22 carbon atoms such as a hexyl group, an octyl group, a decyl group, a dodecyl group, a hexadecyl group or an octadecyl group). More preferably, $Y^1$ represents an alkyl group or an alkenyl group with 8 to 22 carbon atoms. Examples include an octyl group, a decyl group, a dodecyl group, a tridecyl group, a tetradecyl group, a hexadecyl group, an octadecyl group, a docosanyl group, an octenyl group, a decenyl group, a dodecenyl group, a tetradecenyl group, a hexadecenyl group and an octadecenyl group.

$a^1$ and $a^2$, which may be the same or different, preferably each represents a hydrogen atom, a halogen atom (for example, fluorine, chlorine, bromine), a cyano group, an alkyl group with 1 to 3 carbon atoms, $-COO-Z^1$ or $-CH_2COO-Z^1$ (where $Z^1$ represents an aliphatic group with 1 to 22 carbon atoms, such as, for example, a methyl group, an ethyl group, a propyl group, a butyl group, a hexyl group, an octyl group, a decyl group, a dodecyl group, a tridecyl group, a tetradecyl group, a hexadecyl group, an octadecyl group, a docosanyl group, a pentenyl group, a hexenyl group, a heptenyl group, an octenyl group, a decenyl group, a dodecenyl group, a tetradecenyl group, a hexadecenyl group and an octadecenyl group, and these aliphatic groups may have the same substituent groups as those described for $Y^1$ above). More preferably, $a^1$ and $a^2$ each represents a hydrogen atom, an alkyl group with 1 to 3 carbon atoms (for example, a methyl group, an ethyl group, a propyl group), $-COO-Z^3$ or $-CH_2COO-Z^3$ (where $Z^3$ represents an alkyl group or an alkenyl group with 1 to 2 carbon atoms, such as, for example, a methyl group, an ethyl group, a propyl group, a butyl group, a hexyl group, an octyl group, a decyl group, a dodecyl group, a pentenyl group, a hexenyl group, and these alkyl groups and alkenyl groups may have the same substituent groups as those described for $Y^1$).

The dispersion stabilization resin of this invention, which is used in the nonaqueous solvent to produce a stable resin dispersion of the copolymer which is not soluble in the solvent and which is formed by copolymerization of monomers (A) and (B), is a resin which does not contain a grafting group which polymerizes with monomers (A) and (B), and it is a polymer which contains at least one type of repeating unit represented by general formula (I), a portion of which is crosslinked, and it is a polymer produced by bonding at least one type of acidic group selected from a carboxyl group, a sulfo group, a phosphono group, a hydroxyl group, a mercapto group and a

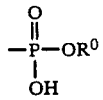

group {where $R^0$ preferably is a hydrocarbon group with 1 to 18 carbon atoms [and more preferably is an aliphatic group with 1 to 8 carbon atoms which may be substituted (for example, a methyl group, an ethyl group, a propyl group, a butyl group, a hexyl group, an octyl group, a 2-chloroethyl group, a 2-methoxyethyl group, a butenyl group, a pentenyl group, a hexenyl group, a benzyl group, a phenethyl group, a bromobenzyl group, a methoxybenzyl group, a chlorobenzyl group, a methylbenzyl group, a cyclopentyl group, a cyclohexyl group), an aryl group with 6 to 10 carbon atoms which may be substituted (for example, a phenyl group, a tolyl group, a xylyl group, a chlorophenyl group, a bromophenyl group, a methoxyphenyl group, an ethylphenyl group, a methoxycarbonylphenyl group)]} to only one terminal of at least one main polymer chain. Here, the acidic group has a chemical structure such that it is directly bonded, or bonded via and desired linking group, to one terminal of the main polymer chain.

The linking group can be any combination of atomic groups with a carbon-carbon bond (single bond or double bond), a carbon-hetero atom bond (for example, with oxygen atom, sulfur atoms, nitrogen atoms and silicon atoms as the hetero atoms) or a hetero atom-hetero atom bond. For example, linking groups of single linking groups or any desired combination of atomic groups such as

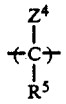

[where $Z^4$ and $Z^5$ respectively denote a hydrogen atom, a halogen atom (for example, fluorine, chlorine, bromine), a cyano group, a hydroxyl group, an alkyl group (for example, a methyl group, an ethyl group, a propyl group)],

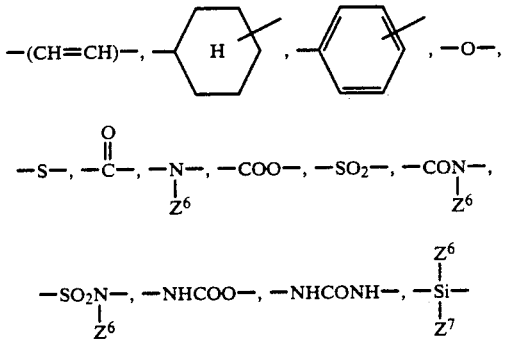

[where $Z^6$ and $Z^7$ each is a hydrogen atom and hydrocarbon groups having the same meaning as $Z^1$ in the above-mentioned general formula (I)].

The polymeric components of the dispersion stabilization resin of this invention contain copolymeric components obtained by polymerization of homopolymeric components or copolymeric components selected from the repeating unit represented by general formula (I) and other monomers copolymerizable with a monomer corresponding to the repeating unit represented by general formula (I); and in addition, the polymer is partially crosslinked.

It is possible to use commonly known methods to introduce a crosslinking structure into the polymer. Thus, a method in which polymerization is carried out in the presence of a polyfunctional monomer in the monomer polymerization reaction, and a method in which crosslinking is carried out in a macromolecular reaction by including a functional group which promotes crosslinking reaction in polymers can be used.

With the dispersion stabilization resins of this invention, crosslinking reactions by polymerization or due to the functional group $—CONHCH_2OZ^8$ (where $Z^8$ denotes a hydrogen atom or an alkyl group) which has a self-crosslinking capability are effective from the standpoint of the simplicity of production (for example, the reaction time is short, the reaction is quantitative, and the contamination, for example, by the use of auxiliary reaction promoting agents is eliminated).

Preferred polymerization reactions are a method in which the polymer chains are crosslinked by the polymerization of monomers having 2 or more polymerizable functional groups together with monomers corresponding to the repeating unit represented by the above-mentioned formula (I).

Examples of polymerizable functional groups include, specifically, for example,

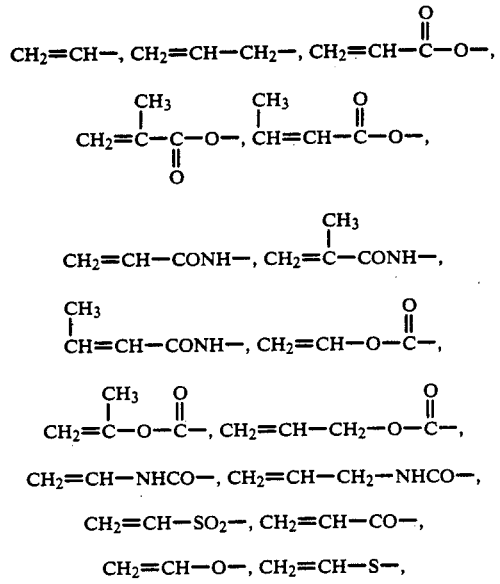

and the above-mentioned monomers having 2 or more polymerizable functional groups may be monomers having 2 or more of these polymerizable functional groups which may be the same or different.

Specific examples of monomers having 2 or more polymerizable functional groups include, as monomers having the same polymerizable functional groups, for example, divinylbenzene, trivinylbenzene, styrene derivatives, polyhydric alcohols (for example, ethylene glycol, diethylene glycol, triethylene glycol, polyethylene glycol #200, #400, #600, 1,3-butylene glycol, neopentyl glycol, dipropylene glycol, polypropylene glycol, trimethylolpropane, trimethylolethane, and pentaerythritol), methacrylic acid, acrylic acid or crotonic acid esters, vinyl ethers or allyl ethers of polyhydroxyphenols (for example, hydroquinone, resorcinol, catechol and derivatives thereof), vinyl esters, allyl esters, vinyl amides or allyl amides of dicarboxylic acids (for example, malonic acid, succinic acid, glutaric acid, adipic acid, pimelic acid, maleic acid, phthalic acid and itaconic acid), and condensates of carboxylic acids containing vinyl groups (for example, methacrylic acid, acrylic acid, crotonic acid, and allyl acetic acids) with polyamines (for example, ethylenediamine, 1,3-propylenediamine and 1,4-butylenediamine).

In addition, monomers having different polymerizable functional groups include, for example, amide derivatives or ester derivatives containing vinyl groups derived from carboxylic acids containing vinyl groups [for example, the methacrylic acid, acrylic acid, methacryloylacetic acid, acryloylacetic acid, methacryloylpropionic acid, acryloylpropionic acid, itaconyloylacetic acid and itaconyloylpropionic acid and the reaction products of alcohols or amines with carboxylic anhydrides (for example, allyloxycarbonylpropionic acid, allyloxycarbonylacetic acid, 2-allyloxycarbonylbenzoic acid and allylaminocarbonylpropionic acid)], (for example, vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, methacrylic acid vinyloxycarbonylmethyl ester, acrylic acid vinyloxycarbonylmethyloxycarbonylethylene ester, N-allylacrylamide, N-allylmethacrylamide, N-allylitaconic acid amide, methacryloylpropionic acid allylamide), or amide derivatives or ester derivatives containing vinyl groups such as condensates of carboxylic acids containing vinyl groups with amino alcohols (for example, aminoethanol, 1-aminopropanol, 1-aminobutanol, 1-aminohexanol and 2-aminobutanol).

The monomer containing 2 or more polymerizable functional groups used in this invention is used at 15% by weight or less, and preferably 10% by weight or less, of the total of the monomers and forms a dispersion stabilization resin which is soluble in the nonaqueous solvent of this invention.

Further, the dispersion stabilization resin of this invention, which is produced by bonding a specific acidic group to only one terminal of at least one polymer main chain, can be readily produced by a synthesis method such as a method in which various agents are reacted on the terminal of a living polymer obtained using conventionally known anion polymerization or cation polymerization (an ionic polymerization method), a method in which a radical polymerization is carried out using a chain transfer agent and/or a polymerization initiator containing a specific acidic group in the molecule (a method using free radical polymerization), or a method in which a polymer containing reactive groups at its terminals obtained by ionic polymerization or free radical polymerization as described above is converted to the specific acidic groups of this invention by a macromolecular reaction.

Specifically, the resins may be produced using a method described, for example, in P. Dreyfuss and R. P. Quirk, *Encycl. Polym. Sci. Eng.*, 7, 551 (1987), S. Nakajo and Y. Yamashita, *Senryo to Yakuhin (Dyes and Reagents)*, 30, 232 (1985), A. Ueda and S. Nagai, *Kagaku to Kogyo (Science and Industry)*, 60, 57 (1986) and other such general texts and the literature cited therein.

The weight average molecular weight of the dispersion stabilization resins of this invention is preferably $1\times10^4$ to $6\times10^5$ and more preferably $2\times10^4$ to $3\times10^5$. With a weight average molecular weight of less than $1\times10^4$, the average particle size of the resin particles obtained by polymerization particle formation increases (for example, it becomes larger than 0.5 μm) and the particle size distribution is broadened. In addition, when it is above $6\times10^5$, the average particle size of the resin particles obtained by polymer particle formation increases and it becomes difficult to maintain the average particle size in the preferred region of 0.15 to 0.4 μm.

More specifically, the dispersion stabilization resin polymers used in this invention can be produced using, for example, (1) a method in which a mixture of the monomer having the repeating unit represented by general formula (I), the above-mentioned polyfunctional monomer and a chain transfer agent containing the acidic group is polymerized using a polymerization initiator (for example, an azobis-based compound or a peroxide), (2) a method in which the above-mentioned chain transfer agent is not used and polymerization is carried out using a polymerization initiator containing the acidic group, (3) a method using a compound containing the acidic group in any of the chain transfer agent and the polymerization initiator, or (4) a method in which the acidic group is introduced by carrying out a polymerization reaction in the three methods above using a compound containing an amino group, a halogen atom, an epoxy group, an acid halide group or the like as a substituent group for the chain transfer agent or polymerization initiator, and then reacting these functional groups in a macromolecular reaction.

Examples of chain transfer agents which can be used are, for example, a mercapto group containing the acidic group or a substituent group from which the acidic group can be derived (for example, thioglycolic acid, thiomalic acid, thiosalicylic acid, 2-mercaptopropionic acid, 3-mercaptopropionic acid, 3-mercaptobutyric acid, N-(2-mercaptopropionyl)glycine, 2-mercaptonicotinic acid, 3-[N-(2-mercaptoethyl)carbamoyl]-propionic acid, 3-[N-(2-mercaptoethyl)amino]propionic acid, N-(3-mercapto-propionyl)alanine, 2-mercaptoethanesulfonic acid, 3-mercaptopropanesulfonic acid, 4-mercaptobutanesulfonic acid, 2-mercaptoethanol, 3-mercapto-1,2-propanediol, 1-mercapto-2-propanol,3-mercapto-2-butanol, mercaptophenol, 2-mercaptoethylamine, 2-mercaptoimidazole and 2-mercapto-3-pyridinol), or iodinated alkyl compounds containing the above-mentioned acidic groups or substituent groups (for example, iodoacetic acid, iodopropionic acid, 2-iodoethanol, 2-iodoethanesulfonic acid, and 3-iodopropanesulfonic acid). Mercapto compounds are preferred.

These chain transfer agents or polymerization initiators are used respectively, in an amount of 0.1 to 15% by weight and preferably 0.5 to 10% by weight per 100 parts by weight of all of the monomers.

The dispersion stabilization resin of this invention, which is produced as described above, is assumed to have a synergistic action with the nonsoluble resin particles due to the acidic group bonded to only one terminal of the main polymer chain and to markedly improve compatibility with the nonaqueous solvent due to the crosslinking of the component which is soluble in the nonaqueous solvent. Thus, it is thought for these reasons that agglutination and sedimentation of the insoluble particles is inhibited and redispersibility is markedly improved.

The monomers used when producing the nonaqueous dispersion resin can be monofunctional monomers (A) which are soluble in the nonaqueous solvent but which are rendered insoluble by polymerization, and monomers (B) which contain aliphatic groups with 8 or more carbon atoms and are represented by the above-mentioned general formula (II) and which form copolymers with monomers (A).

Monomer (A) used in this invention may be any monofunctional monomer which is soluble in the nonaqueous solvent but is rendered insoluble by polymerization. More specifically, monomers represented by general formula (III) are suitable.

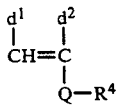

(III)

In general formula (III),

Q represents —COO—, —OCO—, —$CH_2$OCO—, —$CH_2$COO—, —O—,

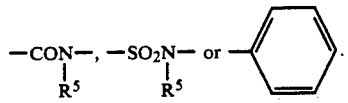

$R^5$ represents a hydrogen atom or an aliphatic group with 1 to 18 carbon atoms which may be substituted (for example, methyl, ethyl, propyl, butyl, 2-chloroethyl, 2-bromoethyl, 2-cyanoethyl, 2-hydroxyethyl, benzyl, chlorobenzyl, methylbenzyl, methoxybenzyl, phenethyl, 3-phenylpropyl, dimethylbenzyl, fluorobenzyl, 2-methoxyethyl and 3-methoxypropyl).

$R^4$ represents a hydrogen atom or an aliphatic group with 1 to 6 carbon atoms which may be substituted (for example, methyl, ethyl, propyl, butyl, 2-chloroethyl, 2,2-dichloroethyl, 2,2,2-trifluoroethyl, 2-bromoethyl, 2-glycidylethyl, 2-hydroxyethyl, 2-hydroxypropyl, 2,3-dihydroxypropyl, 2-hydroxy-3-chloropropyl, 2-cyanoethyl, 3-cyanopropyl, 2-nitroethyl, 2-methoxyethyl, 2-methanesulfonylethyl, 2-ethoxyethyl, N,N-dimethylaminoethyl, N,N-diethylaminoethyl, trimethoxysilylpropyl, 3-bromopropyl, 4-hydroxybutyl, 2-furfurylethyl, 2-thienylethyl, 2-pyridylethyl, 2-morpholinoethyl, 2-carboxyethyl, 3-carboxypropyl, 4-carboxybutyl, 2-phosphoethyl, 3-sulfopropyl, 4-sulfobutyl, 2-carboxyamidoethyl, 3-sulfoamidopropyl, 2-N-methylcarboxyamidoethyl, cyclopentyl, chlorocyclohexyl and dichlorohexyl).

$d^1$ and $d^2$, which may be the same or different, each represents the same groups as $a^1$ or $a^2$ in the above general formula (I).

Specific monofunctional monomers (A) include, for example, vinyl esters or allyl esters of aliphatic carboxylic acids with 1 to 6 carbon atoms (for example, acetic acid, propionic acid, butyric acid, monochloroacetic acid and trifluoropropionic acid), optionally substituted alkyl esters or amides with 1 to 4 carbon atoms of acrylic acid, methacrylic acid, crotonic acid, itaconic acid, maleic acid and other such unsaturated carboxylic acids (with, as examples of alkyl groups, methyl, ethyl, propyl, butyl, 2-chloroethyl, 2-bromoethyl, 2-fluoroethyl, trifluoroethyl, 2-hydroxyethyl, 2-cyanoethyl, 2-nitroethyl, 2-methoxyethyl, 2-methanesulfonylethyl, 2-benzenesulfonylethyl, 2-(N,N-dimethylamino)ethyl, 2-(N,N-diethylamino)ethyl, 2-carboxyethyl, 2-phosphoethyl, 4-carboxybutyl, 3-sulfopropyl, 4-sulfobutyl, 3-chloropropyl, 2-hydroxy-3-chloropropyl, 2-furfurylethyl, 2-pyridinylethyl, 2-thienylethyl, trimethoxysilylpropyl and 2-carboxyamidoethyl), styrene derivatives (for example, styrene, vinyltoluene, α-methylstyrene, vinylnaphthalene, chlorostyrene, dichlorostyrene, bromostyrene, vinylbenzenecarboxylic acid, vinylbenzensulfonic acid, chloromethylstyrene, hydroxymethylstyrene, methoxymethylstyrene, N,N-dimethylaminomethylstyrene, vinylbenzenecarboxamide and vinylbenzenesulfonamide), acrylic acid, methacrylic acid, crotonic acid, maleic acid, itaconic acid and other unsaturated carboxylic acids or cyclic anhydrides of maleic acid and itaconic acid, acrylonitrile, methacrylonitrile, heterocyclic compounds containing polymerizable double bonds (specifically, for example, the compounds described in *Kobunshi Deta Handobukku-Kisohen (Macromolecular Data Handbook—Fundamentals)* edited by the Kobunshi Gakkai (Macomolecular Studies Society), pp. 175–184, Baifukan (1986), for example, N-vinylpyridine, N-vinylimidazole, N-vinylpyrrolidone, vinylthiophene, vinyltetrahydrofuran, vinyloxazoline, vinylthiazole and N-vinylmorpholine).

Two or more monofunctional monomers (A) may be used in combination.

Monomer (B) represented by general formula (II) used in this invention is explained further below.

In general formula (II), $R^1$ preferably represents an optionally substituted alkyl group with 10 or more carbon atoms or an alkenyl group with 10 or more carbon atoms, and T represents —COO—, —CONH—,

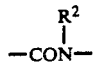

[where $R^2$ preferably is an aliphatic group with 1 to 32 carbon atoms (the aliphatic group being, for example, alkyl, alkenyl or aralkyl)], —OCO—, —$CH_2$OCO— or —O—. $b^1$ and $b^2$, which may the same or different, each preferably represents hydrogen atoms, methyl groups, —$COOR^3$ or —$CH_2COOR^3$ (where $R^3$ preferably is an alkyl group, an alkenyl group, an aralkyl group or a cycloalkyl group with 1 to 32 carbon atoms).

Further, more preferably, in formula (II), T represents —COO—, —CONH or

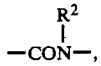

$b^1$ and $b^2$, which may be the same or different, each represents hydrogen atoms or methyl groups, and $R^1$ represents the same groups as mentioned above.

Specific examples of monomer (B) represented by the general formula (II) as described above include esters of unsaturated carboxylic acids such as acrylic acid, methacrylic acid, crotonic acid, maleic acid and itaconic acid having aliphatic groups with 10 to 32 carbon atoms (the aliphatic groups may contain substituent groups such as halogen atoms, hydroxyl groups, amino groups and alkoxy groups, or the carbon bond of the main chain may be interrupted by hetero atoms such as oxygen atoms, sulfur atoms and nitrogen atoms) (the aliphatic groups being, for example, a decyl group a dodecyl group, a tridecyl group, a tetradecyl group, a hexadecyl group, an octadecyl group, a docosanyl group, a dodecenyl group, a hexadecenyl group, an oleyl group, a linoleyl group and a docosenyl group), amides of the unsaturated carboxylic acids described above (the aliphatic groups being the same as those described for the esters), vinyl esters or allyl esters of higher fatty acids (the higher fatty acid being, for example, lauric acid, myristic acid, stearic acid, oleic acid, linoleic acid or behenic acid), or vinyl ethers substituted with aliphatic groups with 10 to 32 carbon atoms (the aliphatic group having the same carbon range as the aliphatic groups for the above-mentioned unsaturated carboxylic acids).

The dispersion resin of this invention comprises at least one of each of monomer (A) and monomer (B), and the essential thing is that, if the resin synthesized from these monomers is not soluble in the nonaqueous solvent, it is possible to obtain the desired dispersion resin. More specifically, monomer (B) represented by general formula (II) is preferably used at 0.1 to 20% by weight, and more preferably at 0.3 to 8% by weight, with respect to the insolubilized monomer (A). Further, the molecular weight of the dispersion resin of this invention is preferably $10^3$ to $10^6$ and more preferably $10^4$ to $10^6$.

In order to produce the dispersion resin used in this invention as described above, it is generally sufficient to heat and polymerize the previously mentioned dispersion stabilization resin, monomer (A) and monomer (B) in the nonaqueous solution in the presence of a polymerization initiator such as benzoyl peroxide, azobisisobutyronitrile or butyl lithium.

Specifically, a method in which the polymerization initiator is added to a mixed solution of monomer (A) and monomer (B) and the dispersion stabilization resin, a method in which the polymerization initiator is added dropwise together with monomer (A) and monomer (B) into a solution in which the dispersion stabilization resin has been dissolved, a method in which the polymerization initiator and the remaining monomer mixture are added as desired to a mixed solution containing part of a mixture of monomer (A) and monomer (B) and the whole of the dispersion stabilization resin, and a method in which a mixed solution of the monomers and the dispersion stabilization resin is added as desired together with the polymerization initiator to the nonaqueous solvent; and it is possible to effect production using any of these methods.

The overall amount of monomer (A) and monomer (B) is about 5 to 80 parts by weight, and preferably 10 to 50 parts by weight per 100 parts by weight of the nonaqueous solvent.

The amount of the soluble resin, which is the dispersion stabilizer, is 1 to 100 parts by weight, and preferably 5 to 50 parts by weight, per 100 parts by weight of all the monomers used as described above.

The amount of the polymerization initiator is appropriately 0.1 to 5% (by weight) of all the monomers.

Further, the polymerization temperature is about 50 to 180° C. and preferably 60 to 120° C. The reaction time is preferably 1 to 15 hours.

Where the end reaction product of monomer (A) and monomer (B), subjected to polymer particle formation, remains, or where the combined use of polar solvents, such as the above-mentioned alcohols, ketones, ethers and esters, are present in the nonaqueous solvent used in the reaction, it is preferable to remove these by reduced pressure distillation or distillation by increasing the temperature to above the boiling point of the monomer or solvent.

The nonaqueous latex particles produced as described above are present as fine particles with a uniform particle size distribution, and in addition, they exhibit extremely stable dispersion properties. In particular, they have good dispersion properties even when used repeatedly over a long period in a developing apparatus, and redispersion is easy even when the developing speed is raised and there is absolutely no adhesive soiling to be seen on the various parts of the apparatus.

Further, in cases involving fixing by means of heating or the like, a strong film is formed and outstanding fixing properties are exhibited.

Further, the liquid developer of this invention has outstanding dispersion stabilization properties, redispersion properties and fixing properties even when the developing and fixing stages are speeded up and masterplates of large size are used.

If desired, colorants may be present in the liquid developers of this invention.

There are no particular limitations on the colorants used and it is possible to use various conventionally known pigments and dyes.

When coloring the dispersion resin itself, one method of coloring is, for example, a method in which the pigment or dye is physically dispersed in the dispersion resin and a large number of useable pigments and dyes are known. For example, magnetic iron oxide powder, powdered lead iodide, carbon black, Nigrosine, alkali blue, Hansa yellow, quinacridone red and phthalocyanine blue can be used.

Another method of coloring is a method of dyeing the dispersion resin with a preferred dye as described in, for example, JP-A No. 57-48738. Alternatively, other methods are a method in which the dispersion resin and the dye are chemically bonded as disclosed in JP-A No. 53-54029, or a method in which a dye-containing copolymer is obtained by using a monomer previously made to contain the dye when carrying out a polymerization granulation method, as described, for example, in JP-B No. 44-22955 (the term "JP-B" as used herein refers to an "examined Japanese patent publication").

If desired, various additives may be added to the liquid developers of this invention in order to reinforce the electric charge properties or to improve the image properties or the like; for example, the substances described specifically in Y. Harasaki, *Denshi Shashin (Electrophotography*, page 44 of Volume 16, No. 2 can be used.

For example, copolymers containing di-2-ethylhexylsulfosuccinic acid metal salts, naphthenic acid metal salts, higher fatty acid metal salts, lecithin, poly(vinylpyrrolidone), and imaleic acid half amide can be used.

The amounts of the various principal components of the liquid developers of this invention are as follows.

The toner particles produced with the resin and, as required colorants as their main component are preferably 0.5 part by weight to 50 parts by weight per 1,000 parts by weight of the carrier liquid. If less than 0.5 part by weight is used, the image density is insufficient, and if in excess of 50 parts by weight is used, fogging is tends to occur in the nonimage areas. Further, a carrier-liquid-soluble resin ıor use in dispersion stabilization as described above is also used as required, and it is possible to add about 0.5 part by weight to 100 parts by weight per 1,000 parts by weight of carrier liquid. Electric charge adjusters as described above are preferably employed at 0.001 part by weight to 1.0 part by weight per 1,000 parts by weight of the carrier liquid. Further, various additives may be employed as desired, and the upper limit for the overall amount of these additives is dependent on the electrical resistance of the developer. Thus, because it is difficult to obtain a continuously graded image of good quality if the electric resistance of the liquid developer is below $10^9$ Ωcm without the toner particles, the various added amounts for the various additives must be controlled within this limit.

Examples of this invention are given below, but the invention is not to be construed as being limited by these examples.

SYNTHESIS EXAMPLE 1

Dispersion Stabilization Resin Production: Production of Dispersion Stabilization Resin P-1

A mixed solution of 97 g of octadecyl methacrylate, 3 g of thioglycolic acid, 5.0 g of divinylbenzene and 200 g of toluene was heated to a temperature of 85° C. while stirring in a nitrogen stream. 0.8 g of 1,1'-azobis(cyclohexane-1-carbonitrile) (abbreviated "ACHN") was added and reacted for 4 hours, following which 0.4 g of ACHN was added and reacted for 2 hours and then a further 0.2 g of ACHN was added and reacted for 2 hours. After cooling, this mixed solution was recrystallized in 1.5 liters of methanol, a white powder was collected by filtration and then dried and 88 g of powder was obtained. The weight average molecular weight of the polymer obtained was 30,000.

SYNTHESIS EXAMPLES 2 TO 9

Dispersion Stabilization Resin Production: Production of Dispersion Stabilization Resins P-2 to P-9

Various dispersion stabilization resins were produced in the same manner as in Synthesis Example 1 except that the monomers shown in Table 1 below were used instead of the octadecyl methacrylate in Synthesis Example 1.

TABLE 1

| Synthesis Example | Dispersion Stabilization Resin | Monomer | Weight Average Molecular Weight |
|---|---|---|---|
| 2 | P-2 | Dodecyl methacrylate (97 g) | 32,000 |
| 3 | P-3 | Tridecyl methacrylate (97 g) | 31,000 |
| 4 | P-4 | Octyl methacrylate (17 g)<br>Dodecyl methacrylate (80 g) | 29,000 |
| 5 | P-5 | Octadecyl methacrylate (70 g)<br>Butyl methacrylate (27 g) | 33,000 |
| 6 | P-6 | Dodecyl methacrylate (92 g)<br>N,N-Dimethylaminoethyl methacrylate (5 g) | 34,000 |
| 7 | P-7 | Octadecyl methacrylate (93 g)<br>2-(Trimethoxysilyloxy)ethyl methacrylate (4 g) | 29,000 |
| 8 | P-8 | Hexadecyl methacrylate (97 g) | 31,000 |
| 9 | P-9 | Tetradecyl methacrylate (97 g) | 32,000 |

SYNTHESIS EXAMPLES 20 TO 22

Dispersion Stabilization Resin Production: Production of Dispersion Stabilization Resins P-10 to P-22

Various dispersion stabilization resins were produced in the same manner as in Synthesis Example 1 except that the polyfunctional monomers or oligomers shown in Table 2 below were used instead of the 5 g of divinylbenzene which was the crosslinking polyfunctional monomer in Synthesis Example 1.

TABLE 2

| Synthesis Example | Dispersion Stabilization Resin | Crosslinking Monomer or Oligomer | Amount Used (g) | Weight Average Molecular Weight |
|---|---|---|---|---|
| 10 | P-10 | Ethylene glycol dimethacrylate | 4 | 35,000 |
| 11 | P-11 | Diethylene glycol dimethacrylate | 4.5 | 29,000 |
| 12 | P-12 | Vinyl methacrylate | 6 | 40,000 |
| 13 | P-13 | Isopropenyl methacrylate | 6 | 33,000 |
| 14 | P-14 | Divinyl adipate | 8 | 32,000 |
| 15 | P-15 | Diallyl glutaconate | 10 | 30,000 |
| 16 | P-16 | ISP-22GA (made by the Okamura Seiyu K.K.) | 10 | 45,000 |
| 17 | P-17 | Triethylene glycol diacrylate | 2 | 50,000 |
| 18 | P-18 | Trivinylbenzene | 2 | 55,000 |
| 19 | P-19 | Polyethylene glycol #400 diacrylate | 5 | 38,000 |
| 20 | P-20 | Polyethylene glycol dimethacrylate | 6 | 40,000 |
| 21 | P-21 | Trimethylolpropane triacrylate | 1.8 | 56,000 |
| 22 | P-22 | Polyethylene glycol #600 diacrylate | 6 | 35,000 |

SYNTHESIS EXAMPLE 23

Dispersion Stabilization Resin Production: Production of Dispersion Stabilization Resin P-23

A mixed solution of 97 g of octadecyl methacrylate, 3 g of thiomalic acid, 4.5 g of divinylbenzene, 150 g of toluene and 50 g of ethanol was heated to a temperature of 60° C. in a nitrogen stream. 0.5 g of 2,2'-azobis-(isobutyronitrile) (abbreviated "AIBN") was added and reacted for 5 hours, following which 0.3 g of AIBN was added and reacted for 3 hours and then a further 0.2 g of AIBN was added and reacted for 3 hours. After cooling, recrystallization was carried out in 2 liters of methanol and a white powder was collected by filtration and then dried. The yield was 85 g and the weight average molecular weight of the polymer was 35,000.

SYNTHESIS EXAMPLES 24 TO 29

Dispersion Stabilization Resin Production: Production of Dispersion Stabilization Resins P-24 to P-29

Dispersion stabilization resins were produced in the same manner as in Synthesis Example 23 except that the mercapto compounds shown in Table 3 below were used instead of the 3 g of thiomalic acid in Synthesis Example 23.

TABLE 3

| Synthesis Example | Dispersion Stabilization Resin | Mercapto Compound | Weight Average Molecular Weight |
|---|---|---|---|
| 24 | P-24 | $HSCH_2CH_2COOH$ | 36,000 |
| 25 | P-25 | 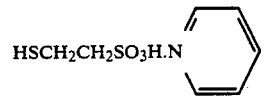 | 29,000 |
| 26 | P-26 | 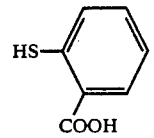 | 38,000 |
| 27 | P-27 | 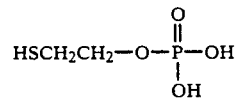 | 33,000 |
| 28 | P-28 | $HSCH_2CH_2NHCO(CH_2)_2COOH$ | 37,000 |
| 29 | P-29 | $HSCH_2CH_2NHCH_2CH_2COOH$ | 35,000 |

SYNTHESIS EXAMPLE 30

Dispersion Stabilization Resin Production: Production of Dispersion Stabilization Resin P-30

A mixture of 94 g of hexadecyl methacrylate, 1.0 g of diethylene glycol dimethacrylate, 150 g of toluene and 50 g of isopropyl alcohol was heated to a temperature of 90° C. in a nitrogen stream. 6 g of 2,2'-azobis(4-cyanovalerate) (abbreviated ACV) was added and reacted for 8 hours. After cooling, this reaction solution was recrystallized in 1.5 liters of methanol and a white powder was collected by filtration and then dried. The yield was 83 g and the weight average molecular weight of the polymer was 65,000.

SYNTHESIS EXAMPLE 31

Dispersion Stabilization Resin Production: Production of Dispersion Stabilization Resin P-31

A mixed solution of 92 g of docosanyl methacrylate, 1.5 g of ISP-22GA (made by the Okamura Seiyu K.K.), 150 g of toluene and 50 g of ethanol was heated to a temperature of 80° C. in a nitrogen stream. 8 g of 4,4'-azobis(4-cyanopentanol) was added and reacted for 8 hours. After cooling, this reaction solution was recrystallized in 1.5 liters of methanol and a white powder was collected by filtration and then dried. The yield was 78 g and the weight average molecular weight of the polymer was 41,000.

SYNTHESIS EXAMPLE 32

Dispersion Stabilization Resin Production: Production of Dispersion Stabilization Resin P-32

A mixed solution of 95 g of octadecyl methacrylate, 5 g of 2-mercaptoethylamine, 5 g of divinylbenzene and 200 g of toluene was heated to a temperature of 85° C. in a nitrogen stream. 0.7 g of ACHN was added and reacted for 8 hours.

Following this, 8 g of glutaconic anhydride and 1 ml of concentrated sulfuric acid were added and reacted for 6 hours at a temperature of 100° C. After cooling, recrystallization was carried out in 1.5 liters of methanol and a white powder was collected by filtration and then dried. The yield was 83 g and the weight average molecular weight was 31,000.

SYNTHESIS EXAMPLE 33

Dispersion Stabilization Resin Production: Production of Dispersion Stabilization Resin P-33

A mixed solution of 95 g of octadecyl methacrylate, 3 g of thioglycolic acid, 6 g of ethylene glycol dimethacrylate, 150 g of toluene and 50 g of ethanol was heated to a temperature of 80° C. in a nitrogen stream. 2 g of ACV was added and reacted for 4 hours and then a further 0.5 g of ACV was added and reacted for 4 hours. After cooling, recrystallization was carried out in 1.5 liters of methanol and a white powder was collected by filtration and then dried. The yield was 80 g and the weight average molecular weight was 35,000.

SYNTHESIS EXAMPLE 34

Dispersion Stabilization Resin Production: Production of Dispersion Stabilization Resin P-34

A mixed solution of 94 g of tridecyl methacrylate, 6 g of 2-mercaptoethanol, 9 g of divinylbenzene, 150 g of toluene and 50 g of ethanol was heated to a temperature of 80° C. in a nitrogen stream. 4 g of ACHN was added and reacted for 4 hours and then a further 2 g of ACHN was added and reacted for 4 hours.

After cooling, recrystallization was carried out in 1.5 liters of methanol, the methanol was removed by decantation and the viscous substance was dried. The yield was 75 g and the weight average molecular weight was 29,000.

SYNTHESIS EXAMPLE 35

Dispersion Stabilization Resin Production: Production of Dispersion Stabilization Resin P-35

A mixture of 50 g of the above-mentioned Dispersion Stabilization Resin P-34, 100 g of toluene, 10 g of succinic anhydride and 0.5 g of pyridine was reacted for 10 hours at a temperature of 90° C. After cooling, recrystallization was carried out in 0.8 liter of methanol, the methanol was removed by decantation and the viscous substance was dried. The yield was 43 g and the weight average molecular weight was 30,000.

SYNTHESIS EXAMPLES 36 TO 39

Dispersion Stabilization Resin Production: Production of Dispersion Stabilization Resins P-36 to P-39

Various dispersion stabilization resins were produced in the same manner as in Synthesis Example 35 except that the dicarboxylic acid anhydrides shown in Table 4 below were used instead of the succinic acid anhydride in Synthesis Example 35 for the above-mentioned Dispersion Stabilization Resin P-35.

TABLE 4

| Synthesis Example | Dispersion Stabilization Resin | Dicarboxylic Anhydride | Amount Used (g) | Weight Average Molecular Weight |
|---|---|---|---|---|
| 36 | P-36 | Maleic anhydride | 8.5 | 30,000 |
| 37 | P-37 | Adipic anhydride | 11 | " |
| 38 | P-38 | Phthalic anhydride | 10 | " |
| 39 | P-39 | Trimellitic anhydride | 12.5 | " |

SYNTHESIS EXAMPLE 40

Dispersion Stabilization Resin Production: Production of Dispersion Stabilization Resin P-40

A mixture of 86 g of octadecyl methacrylate, 10 g of N-methoxymethylacrylamide, 4 g of thioglycolic acid, 150 g of toluene and 50 g of isopropanol was heated to a temperature of 80° C. in a nitrogen stream.

0.8 g of ACHN was added and reacted for 8 hours. Following this, the temperature was raised to 110° C. and stirring carried out for 6 hours using the Dean-Stark method. The isopropanol which was the solvent used and the methanol which was created as a by-product in the reaction were removed.

After cooling, recrystallization was carried out in 1.5 liters of methanol, a white powder was collected by filtration and then dried. The yield was 82 g and the weight average molecular weight was 45,000.

SYNTHESIS EXAMPLE 41

Latex Particle Production: Production of Latex Particles D-1

A mixed solution of 12 g of Dispersion Stabilization Resin P-1, 100 g of vinyl acetate, 1.0 g of octadecyl methacrylate and 384 g of Isopar H was heated to a temperature of 70° C. while stirring in a nitrogen stream 0.8 g of 2,2'-azobis(isovaleronitrile) (abbreviated AIVN) was added and reacted for 6 hours. A white suspension was produced 20 minutes after the addition of the initiator and the reaction temperature rose to 88° C. The temperature was increased to 100° C. and stirring was carried out for 2 hours and the unreacted vinyl acetate was removed by distillation. After cooling, the white dispersion which was obtained by passing through a 200 mesh nylon cloth was a latex with a polymerization rate of 90% and an average particle size of 0.24 μm.

SYNTHESIS EXAMPLES 42 TO 52

Latex Particle Production: Production of Latex Particles D-2 to D-12

Latex Particles D-2 to D-12 of this invention were produced in the same manner as in Synthesis Example 41 except that the dispersion stabilization resins described in Table 5 below were used instead of Resin P-1 in latex particle Synthesis Example 41.

TABLE 5

| Synthesis Example | Latex Particle | Dispersion Stabilization Resin | Latex Polymerization Rate (%) | Latex Average Particle Size (μm) |
|---|---|---|---|---|
| 42 | D-2 | P-2 | 88 | 0.25 |
| 43 | D-3 | P-3 | 89 | 0.24 |
| 44 | D-4 | P-4 | 87 | 0.26 |
| 45 | D-5 | P-5 | 90 | 0.24 |
| 46 | D-6 | P-6 | 85 | 0.23 |
| 47 | D-7 | P-7 | 86 | 0.25 |
| 48 | D-8 | P-8 | 85 | 0.23 |
| 49 | D-9 | P-9 | 88 | 0.24 |
| 50 | D-10 | P-13 | 83 | 0.27 |
| 51 | D-11 | P-15 | 86 | 0.28 |
| 52 | D-12 | P-24 | 86 | 0.22 |

SYNTHESIS EXAMPLES 53 TO 58

Latex Particle Production: Production of Latex Particles D-13 to D-18

Various latex particles were produced in the same manner as in Synthesis Example 41 for Latex Particles D-1 except that 1 g, respectively, of the monomers shown in Table 6 below was used instead of the 1 g, respectively, of octadecyl methacrylate in Synthesis Example 41.

TABLE 6

| Latex Particle Synthesis Example | Latex Particle | Monomer | Latex Polymerization Rate (%) | Latex Average Particle Size (μm) |
|---|---|---|---|---|
| 53 | D-13 | Docosanyl methacrylate | 87 | 0.23 |
| 54 | D-14 | Hexadecyl methacrylate | " | 0.24 |
| 55 | D-15 | Tetradecyl methacrylate | 88 | 0.24 |
| 56 | D-16 | Tridecyl methacrylate | 86 | 0.24 |
| 57 | D-17 | Dodecyl methacrylate | " | 0.23 |
| 58 | D-18 | Decyl methacrylate | 87 | 0.26 |

SYNTHESIS EXAMPLE 59

Latex Particle Production: Production of Latex Particles D-19

A mixed solution of 6 g of Dispersion Stabilization Resin P-10, 8 g of poly(octadecyl methacrylate), 100 g of vinyl acetate, 0.8 g of dodecyl methacrylate and 400 g of Isopar H was heated to a temperature of 75° C. while stirring in a nitrogen stream. 0.7 g of 2,2'-azobis-(isobutyronitrile) (abbreviated "AIBN") was added and reacted for 4 hours and then a further 0.5 g of AIBN was added and reacted for 2 hours. After cooling, a white dispersion was obtained by passing through a 200 mesh nylon cloth and was a latex with an average particle size of 0.20 μm.

SYNTHESIS EXAMPLE 60

Latex Particle Production: Production of Latex Particles D-20

A mixed solution of 10 g of Dispersion Stabilization Resin P-11, 90 g of vinyl acetate, 10 g of N-vinylpyrrolidone, 1.5 g of octadecyl methacrylate and 400 g of isododecane was heated to a temperature of 65° C. while stirring in a nitrogen stream. 1.5 g of AIBN was added and reacted for 4 hours. After cooling, the white dispersion obtained by passing through a 200 mesh nylon cloth was a latex with an average particle size of 0 25 μm.

SYNTHESIS EXAMPLE 61

Latex Particle Production: Production of Latex Particles D-21

A mixed solution of 20 g of Dispersion Stabilization Resin P-1, 94 g of vinyl acetate, 6 g of crotonic acid, 2 g of hexadecyl methacrylate and Isopar G was heated to a temperature of 60° C. while stirring in a nitrogen stream. 1.0 g of AIVN was added and reacted for 2 hours. A further 0.5 g of AIVN was added and reacted for 2 hours. After cooling, the white dispersion obtained by passing through a 200 mesh nylon cloth was a latex with an average particle size of 0.28 μm.

SYNTHESIS EXAMPLE 62

Latex Particle Production: Production of Latex Particles D-22

A mixed solution of 25 g of Dispersion Stabilization Resin P-16, 100 g of methyl methacrylate, 2 g of decyl methacrylate, 0.8 g of n-dodecyl mercaptan and Isopar H was heated to a temperature of 60° C. while stirring in a nitrogen stream. 0.7 g of AIVN was added and reacted for 4 hours. After cooling, the white dispersion obtained by passing through a 200 mesh nylon cloth was a latex with an average particle size of 0.25 μm.

SYNTHESIS EXAMPLE 63

Latex Particle Production: Production of Latex Particles D-23

A mixed solution of 25 g of Dispersion Stabilization Resin P-15, 100 g of styrene, 2 g of octadecyl vinyl ether and 380 g of Isopar H was heated to a temperature of 45° C. while stirring in a nitrogen stream. A hexane solution of n-butyl lithium was added to an amount of 1.0 g as solid n-butyl lithium and the reaction was carried out for 4 hours. After cooling, the white dispersion obtained by passing through a 200 mesh nylon cloth was a latex with an average particle size of 0.35 μm.

SYNTHESIS EXAMPLE 64

Latex Particle Production (Comparative Example A)

A white dispersion of latex particles with a polymerization rate of 88% and an average particle size of 0.27 μm was obtained in the same manner as in latex particle Synthesis Example 41 except that a mixed solution of 20 g of poly(octadecyl methacrylate) (Dispersion Stabilization Resin (R)-1), 100 g of vinyl acetate, 1 g of octadecyl methacrylate and 380 g of Isopar H was used.

SYNTHESIS EXAMPLE 65

Latex Particle Production (Comparative Example B)

A mixed solution of 97 g of octadecyl methacrylate, 3 g of acrylic acid and 200 g of toluene was heated to a temperature of 75° C. in a nitrogen stream. 1.0 g of AIBN was added and reacted for 8 hours. Following this, 12 g of glycidyl methacrylate, 1.0 g of t-butylhydroquinone and 1.2 g of N,N-dimethyldodecylamine were added and stirring was carried out for 40 hours at a temperature of 100° C. After cooling, recrystallization was carried out in 2 liters of methanol and a white powder was collected by filtration and dried. Dispersion Stabilization Resin (R)-2 with the following structure was obtained. The yield was 84 g and the $\overline{M}w$ was 35,000.

Dispersion Stabilization Resin (R)-2

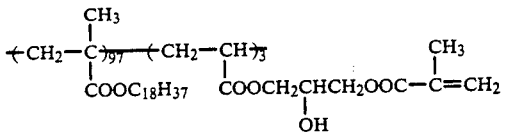

A white dispersion of latex particles with a polymerization rate of 89% and an average particle size of 0.15 μm was obtained in the same manner as in latex particle Synthesis Example 41 except that use was made of a mixed solution of 10 g of this Dispersion Stabilization Resin (R)-2, 100 g of vinyl acetate, 1.0 g of octadecyl methacrylate and 384 g of Isopar H.

SYNTHESIS EXAMPLE 66

Latex Particle Production (Comparative Example C)

A white dispersion of latex particles with a polymerization rate of 87% and an average particle size of 0.23 μm was obtained in the same manner as in latex particle Synthesis Example 41 except that use was made of a mixed solution of 12 g of Dispersion Stabilization Resin (R)-3 with the following formula, which had been prepared in accordance with the method described in JP-A No. 61-63855, 100 g of vinyl acetate, 1.0 g of octadecyl methacrylate and 382 g of Isopar H.

Dispersion Stabilization Resin (R)-3

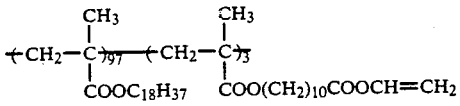

/ w: 46,000 (compositional ratio by weight)

EXAMPLE 1

10 g of a dodecyl methacrylate/acrylic acid copolymer (copolymer ratio 95/5 (weight ratio)), 10 g of Nigrosine and 30 g of Isopar G were placed in a paint shaker (Tokyo Seiki K.K.) together with glass beads and dispersed for 4 hours to obtain a fine dispersion of Nigrosine.

An electrostatic photographic liquid developer was prepared by using 1 liter of Isopar G to dilute 30 g of the resin dispersion of latex particle Synthesis Example 41, 2.5 g of the above-mentioned Nigrosine dispersion, 15 g of the higher alcohol FOC-1600 (made by Nissan Kagaku K.K.), and 0.07 g of an octadecene/octadecyl maleic acid half amide copolymer.

Comparative Liquid Developers A to C

The three types of Comparative Liquid Developers A, B and C were prepared by substituting the following resin particles for the resin dispersion in the above-mentioned synthesis examples.

Comparative Liquid Developer A

The resin dispersion of latex particle Synthesis Example 64

Comparative Liquid Developer B

The resin dispersion of latex particle Synthesis Example 65

Comparative Liquid Developer C

The resin dispersion of latex particle Synthesis Example 66

These liquid developers were used as the developers for the fully automatic plate making machine ELP 404 V (made by the Fuji Photo Film Co., Ltd.), and the electrophotographic photosensitive material ELP master II type (made by the Fuji Photo Film Co., Ltd.) was exposed and development processing carried out. The plate making speed was 7 plates/minute. Further, observations were made for the presence of toner adhesion soiling on the developing apparatus after processing 2,000 sheets of the ELP master II type. A 40% original was used for the reproduced image blackening rate (image area). The results are given in Table 7 below.

TABLE 7

| No. | Example | Developer | Development Apparatus Soiling | Plate Image at 2,000 Copies |
|---|---|---|---|---|
| 1 | Invention | Example 1 | Good (Absolutely no soiling) | Good (Clear) |
| 2 | Comparative Example A | Developer A | Very Poor (Marked production of toner residue) | Very Poor (Occurrence of lettering defects, scratching in the greased area and base fogging) |
| 3 | Comparative Example B | Developer B | Very Poor (Slight occurrence of toner residue) | Very Poor-Poor (Deterioration in the density of the greased portions of the image portion, occurrence of lettering scratches) |
| 4 | Comparative Example C | Developer C | Very Poor - Poor (Occurrence of slight toner residue) | Poor (Deterioration in the density of the greased portions of the image portion) |

As is clear from the results in Table 7 above, when plate making was carried out using the various developers under the plate making conditions mentioned above, the developer of this invention was the only developer in which soiling of the developing apparatus did not occur and in which the image of the 2,000th plate making plate was clear.

Meanwhile, when offset printing masterplates (ELP masters) obtained by plate making using the respective developers were printed conventionally and a comparison was made of the number of prints required for the occurrence of lettering dropouts in the print image, blur in the greased portion and the like, these had not occurred even in excess of 10,000 copies for the masterplates obtained using the developers of this invention, Comparative Example A, Comparative Example B and Comparative Example C.

As can be seen from the above results, only product employing the developers using the resin particles of this invention gave rise to absolutely no soiling of the developing apparatus and had a good masterplate printed copy count.

Although there is no problem in the printed copy count for Comparative Examples A, B and C, soiling of the developing apparatus occurred and they were not able to withstand continuous use.

The soiling of the developing apparatus in Comparative Examples B and C was dramatically improved when compared with Comparative Example A, but a satisfactory performance was not achieved when the developing conditions became harsh. Thus, known dispersion stabilization resins of Comparative Examples B and C have a characteristic chemical structure in which the component containing the polymerizable double bonded group, which copolymerizes with monomer (A) (vinyl acetate in this example) present in the polymer, is randomly copolymerized in the polymer. It is thought that for this reason the latex particle redispersibility is inferior to that of the dispersion stabilization resins of this invention.

EXAMPLE 2

A mixture of 100 g of the white dispersion obtained in latex particle Synthesis Example 42 and 1.5 g of Sumikaron black was heated to a temperature of 100° C. and stirring was carried out with heating for 4 hours. After cooling to room temperature, a black resin dispersion with an average particle size of 0.20 μm was obtained by passing through a 200 mesh nylon cloth and removing the dye which remained.

A liquid developer was prepared using 1 liter of Shellsol 71 to dilute 32 g of the above-mentioned black resin dispersion and 0.05 g of zirconium naphthenate.

When this was developed using the same apparatus as in Example 1, absolutely no toner adhering soiling occurred in the apparatus even after developing 2,000 copies.

Further, the image quality of the offset printing masterplate obtained was clear and the image quality of prints after printing 10,000 copies was extremely clear.

EXAMPLE 3

A mixture of 100 g of the white dispersion obtained in latex particle Synthesis Example 61 and 3 g of Victoria Blue B was heated to a temperature of 70° C. to 80° C. and stirred for 6 hours. After cooling to room temperature, a blue resin dispersion with an average particle size of 0.16 μm was obtained by passing through a 200 mesh nylon cloth and removing the dye which remained.

A liquid developer was prepared by using 1 liter of Isopar H to dilute 32 g of the above-mentioned blue resin dispersion and 0.05 g of zirconium naphthenate.

When this was developed using the same apparatus as in Example 1, absolutely no toner adhering soiling occurred in the apparatus even after developing 2,000 copies. Further, the image quality of the offset printing masterplate obtained was clear and the image quality of the prints was extremely clear after printing 10,000 copies.

EXAMPLE 4

A liquid developer was prepared by using 1 liter of Isopar G to dilute 32 g of the white dispersion obtained in latex particle Synthesis Example 52, 2.5 g of the Nigrosine dispersion obtained in Example 1 and 0.02 g of the docosanyl monoamide compound of the copolymer of diisobutylene and maleic anhydride.

When this was developed using the same apparatus as in Example 1, there was absolutely no toner adhesive soiling in the apparatus even after developing 2,000 copies. Further, the image quality of the offset printing masterplate obtained and the image quality of the prints after printing 10,000 copies was clear.

Further, this developer was left for 3 months and then exactly the same processing as that described above was carried out, but there was absolutely no change compared with before aging.

EXAMPLE 5

10 g of poly(decyl methacrylate), 30 g of Isopar H and 8 g of Alkali Blue were placed in a paint shaker together with glass beads, dispersion was carried out for 2 hours and a fine dispersion of Alkali Blue was obtained.

A liquid developer was prepared by using 1 liter of Isopar G to dilute 30 g of the white resin dispersion obtained in latex particle Synthesis Example 41, 4.2 g of the above-mentioned Alkali Blue dispersion, 15 g of the higher alcohol FOC-1400 (made by Nissan Kagaku K.K.) and 0.06 g of the docosanyl half amide compound of the copolymer of diisobutylene and maleic anhydride.

When this was developed using the same apparatus in Example 1, there was absolutely no toner adhesion soiling in the apparatus even after developing 2,000 copies. Further, the image quality of the offset printing masterplate obtained and the image quality of the prints after printing 10,000 copies was extremely clear.

EXAMPLES 6 TO 21

Liquid developers were prepared in the same manner as in Example 5 except that an amount of 6.0 g as the solid latex particles shown in Table 8 below was used instead of the white resin dispersion of latex particle Synthesis Example 41 in Example 5.

TABLE 8

| Example No. | Latex Particles | Soiling of the Developing Apparatus | Plate Image at 2,000 Copies |
|---|---|---|---|
| 6 | D-4 | Good (Absolutely no occurrence of soiling) | Good (Clear) |
| 7 | D-5 | " | " |
| 8 | D-6 | " | " |

TABLE 8-continued

| Example No. | Latex Particles | Soiling of the Developing Apparatus | Plate Image at 2,000 Copies |
|---|---|---|---|
| 9 | D-7 | " | " |
| 10 | D-8 | " | " |
| 11 | D-10 | " | " |
| 12 | D-11 | " | " |
| 13 | D-12 | " | " |
| 14 | D-13 | " | " |
| 15 | D-14 | " | " |
| 16 | D-15 | " | " |
| 17 | D-16 | " | " |
| 18 | D-17 | " | " |
| 19 | D-18 | " | " |
| 20 | D-19 | " | " |
| 21 | D-20 | " | " |

When this was developed in the same apparatus as in Example 1, there was absolutely no toner adhesive soiling in the apparatus even after developing 2,000 copies. Further, the image quality of the offset printing masterplate obtained and the image quality of the prints after printing 10,000 copies was extremely good.

According to this invention, developing solutions are obtained with outstanding stable dispersion properties, redispersion properties and fixing properties. In particular, soiling does not occur in the developing unit and the image quality of the offset printing masterplate obtained and the image quality of the prints after printing 10,000 copies is extremely clear even when used under plate making conditions with an extremely fast plate making speed.

While the invention has been described in detail and with reference to specific embodiments thereof, it will be apparent to one skilled in the art that various changes and modifications can be made therein without departing from the spirit and scope thereof.

What is claimed is:

1. An electrostatic photographic liquid developer comprising a nonaqueous solvent with an electric resistance of 109 Ωcm or more and a dielectric constant of 3.5 or less, having a resin dispersed therein, wherein dispersion resin particles are copolymer resin particles obtained by the copolymerization reaction of solutions containing at least one monofunctional monomer (A) which is soluble in the nonaqueous solvent but which is rendered insoluble by polymerization, and monomer (B) which is represented by the general formula (II) below

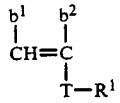

(II)

wherein $R^1$ represents an aliphatic group with 8 or more carbon atoms;

T represents —COO—, —CONH—,

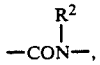

where $R^2$ represents an aliphatic group, —OCO—, —$CH_2$COO— or —O—; and $b^1$ and $b^2$, which may be the same or different, each represents a hydrogen atom, an alkyl group, a —$COOR^3$ group, or a —$CH_2$—$COOR^3$ group, where $R^3$ represents an aliphatic group, which contains an aliphatic group with 8 or more carbon atoms and which produces a copolymer by polymerization with monomer (A); in the presence of a dispersion stabilization resin which is soluble in the nonaqueous solvent, which comprises an acidic group selected from the group consisting of a —$PO_3H_2$ group, an —$SO_3H$ group, a —COOH group, an —OH group, an —SH group, or a

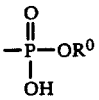

group, where $R^0$ denotes a hydrocarbon bonded only to one terminal of at least one main polymer chain and which is a polymer containing the repeating unit represented by the following general formula (I)

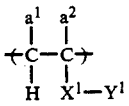

(I)

wherein $X^1$ represents —COO—, —OCO—, —$CH_2$OCO—, —$CH_2$COO—, —O— or —$SO_2$—;

$Y^1$ represents an aliphatic group with 6 to 32 carbon atoms; and $a^1$ and $a^2$, which may be the same or different, each represents a hydrogen atom, a halogen atom, a cyano group, a hydrocarbon group with 1 to 8 carbon atoms, a—COO—$Z^1$ group, or a —COO—$Z^1$ group linked via a hydrocarbon group with 1 to 8 carbon atoms, where $Z^1$ represents a hydrocarbon group with 1 to 22 carbon atoms; and wherein a portion of said polymer is crosslinked.

2. The liquid developer according to claim 1, wherein the nonaqueous solvent as a carrier liquid is a linear chain or branched chain aliphatic hydrocarbon, an alicyclic hydrocarbon, an aromatic hydrocarbon, a halogen derivative thereof or a mixture thereof.

3. The liquid developer according to claim 1, wherein X is —COO—, —OCO—, —$CH_2$OCO—, —$CH_2$COO— or —O—, $Y^1$ is an aralkyl group, an alkenyl group or an alkyl group, each having from 8 to 22 carbon atoms.

4. The liquid developer according to claim 1, wherein the amount of the repeating unit represented by general formula (II) in said copolymeric resin is from 0.1 wt% to 20 wt%.

5. The liquid developer according to claim 1, wherein the weight average molecular weight of the resin for dispersion stabilization purposes is from $1\times104$ to $6\times10^5$.

6. The liquid developer according to claim 1, wherein the dispersed resin particles are colored dispersed resin particles.

7. The liquid developer according to claim 1, wherein the dispersed resin particles as toner particles are present in an amount from 0.5 to 50 parts per 100 parts by weight of the carrier liquid.

* * * * *